US011173336B1

(12) United States Patent
Xu

(10) Patent No.: US 11,173,336 B1
(45) Date of Patent: Nov. 16, 2021

(54) SMART WEIGHTED HULA HOOP

(71) Applicant: Siyun Xu, Jiujiang (CN)

(72) Inventor: Siyun Xu, Jiujiang (CN)

( * ) Notice: Subject to any disclaimer, the term of this patent is extended or adjusted under 35 U.S.C. 154(b) by 0 days.

(21) Appl. No.: 17/335,088

(22) Filed: Jun. 1, 2021

(51) Int. Cl.

| | |
|---|---|
| ***A63B 21/06*** | (2006.01) |
| ***A63B 19/00*** | (2006.01) |
| *A63B 19/02* | (2006.01) |
| *A63B 21/00* | (2006.01) |
| *A63B 23/02* | (2006.01) |

(52) U.S. Cl.
CPC ..... *A63B 21/0608* (2013.01); *A63B 19/00* (2013.01); *A63B 21/0602* (2013.01); *A63B 19/02* (2013.01); *A63B 21/0004* (2013.01); *A63B 23/0205* (2013.01)

(58) Field of Classification Search
CPC .. A63B 7/02; A63B 7/08; A63B 19/00; A63B 19/02; A63B 19/04; A63B 21/0608; A63B 21/0004; A63B 21/06; A63B 21/0601; A63B 21/0602; A63B 21/0607; A63B 21/065; A63B 21/4019; A63B 21/4039; A63B 21/4049; A63B 23/0205; A63B 23/0211
See application file for complete search history.

(56) References Cited

U.S. PATENT DOCUMENTS

| | | | | |
|---|---|---|---|---|
| 4,380,885 | A * | 4/1983 | Komagata | A63B 19/00 446/236 |
| 6,217,482 | B1 * | 4/2001 | Yoo | A63B 19/00 482/10 |
| 9,687,688 | B2 * | 6/2017 | Hsiao | A63B 19/00 |
| 11,090,521 | B2 * | 8/2021 | Yoon | A63B 24/0006 |
| 2019/0329324 | A1 * | 10/2019 | Greenberg | C23C 28/00 |

* cited by examiner

*Primary Examiner* — Megan Anderson

(57) ABSTRACT

The present disclosure provides a smart weighted hula hoop including a first connecting frame, second connecting frames, and a connecting plate connected with a connecting head. The first connecting frame and the second connecting frames include protruding columns and fastening plates. Each protruding column is snapped on a corresponding fastening plate to make the first connecting frame connected to the second connecting frames. A housing is connected to the first connecting frame. A magnetic sensor is connected to the housing. The first connecting frame and the second connecting frame are connected to sleeves. The bottom end of each sleeve is connected to a respective spring. A fixing sleeve is arranged on each spring. Fixing sleeves are connected to top blocks. A connecting rope is arranged on the connecting head. The connecting rope passes through a lock ring. The lock ring passes through a tapered weight ball.

9 Claims, 3 Drawing Sheets

SMART WEIGHTED HULA HOOP

TECHNICAL FIELD

The present disclosure relates to a field of hula hoops technology, and in particular to a smart weighted hula hoop.

BACKGROUND

A hula hoop is also called a fitness hoop. Because the hula hoop is light and beautiful in appearance, and does not occupy a large area for hula hooping, hula hooping has quickly become a sport for all ages. Skilled people are able to get exercises for waist and abdomen muscles, buttocks muscles, and leg muscles, and effectively improve flexibility and flexibility of waists, hip and knee joints of their bodies. In addition to being used as a general toy, the hula hoop is also used in competitions, acrobatics, or as a weight loss device.

Ordinary hula hoops are unable to massage the waist of the human body. It can only be rotated on the waist of the human body by rotating. The waist tissue of the human body is easy injured when hula hooping. Meanwhile, the hula hoop is unable to realize a weighting function and the hula hoops have poor adaptability, low intelligence, and low intelligence. Thus, it is necessary to provide a smart weighted hula hoop.

SUMMARY

In view of the defects in the prior art, the present disclosure provides a smart weighted hula hoop, which solves problems of low adaptability, poor use effect and low intelligence of a conventional hula hoop.

To achieve the above object, the present disclosure provides a smart weighted hula hoop. The smart weighted hula hoop comprises a first connecting frame, a plurality of second connecting frames, and a connecting plate.

The first connecting frame and the second connecting frames comprise protruding columns and fastening plates. A snap-on groove is defined on each fastening plate. Each fastening plate is fixedly connected with a respective protruding column through each snap-on groove. Each protruding column is snapped on a corresponding fastening plate to make the first connecting frame connected to the second connecting frames. The plurality of second connecting frames are connected one by one in sequence. One side of the first connecting frame is connected to a second connecting frame arranged in a head end of the second connecting frames connected one by one in sequence. Another side of the first connecting frame is connected to another second connecting frame arranged on a tail end of the second connecting frames connected one by one in sequence. The first connecting frame is connected with the plurality of second connecting frames to form a hula hoop body.

A housing is fixedly connected to the first connecting frame. A magnetic sensor is fixedly connected to the housing. A display screen is fixedly connected to an upper end of the housing. A circuit board is arranged inside the housing. The first connecting frame and each second connecting frame are fixedly connected to a respective sleeve. A limit hole is provided on a bottom end of each sleeve. A support column is slidably connected to an inner wall of each limit hole. The bottom end of each sleeve is fixedly connected to a respective spring. A fixing sleeve is arranged on one end of each spring away from each sleeve. Each fixing sleeve is fixedly connected to a respective top block. Each fixing sleeve is slidably connected to each sleeve.

The first connecting frame and the second connecting frames comprise openings. A roller is arranged on the connecting plate. The connecting plate is fixedly connected with a connecting head. A connecting rope is arranged on the connecting head. The connecting rope passes through a lock ring. The lock ring passes through a tapered weight ball. A bottom end of the tapered weight ball is threadedly connected with a blocking cover.

Optionally, the first connecting frame and the second connecting frames comprise reinforcing blocks. Reinforcing plates are arranged on each reinforcing block. Each sleeve is arranged between two corresponding reinforcing blocks oppositely arranged with respect to each other.

Optionally, each sleeve comprises a rectangular groove. An inner sidewall of each rectangular groove is slidably connected with corresponding limit blocks. Each fixing sleeve is fixedly connected with bottom ends of corresponding limit blocks.

Optionally, a lock seat is arranged on an inner bottom portion of each fixing sleeve. Each lock seat is integrally connected to each fixing sleeve. Each spring is fixedly connected to each lock seat.

Optionally, a touch switch is arranged on a right side of the display screen. A sealant is disposed between the touch switch and the housing.

Optionally, the tapered weight ball is hollow. The tapered weight ball is configured to store liquid water.

Optionally, the connecting plate is arranged in the second connecting frames. Inner walls of the roller are fixedly connected to a bearing. Inner walls of the bearing are fixedly connected with a fixing rod. A bottom end of the fixing rod is fixedly connected with the connecting plate.

Optionally, a connecting rod is fixedly connected to the connecting head. The connecting rope is arranged on the connecting rod, and the connecting rope is fixed to the connecting rod by knotting the connecting rope.

Optionally, the first connecting frame and the second connecting frames comprise through holes. Each support column is arranged inside a respective through hole. A limit plate is arranged on each support column to limit sliding of each support column and each sleeve.

A working principle is as follow. A user first mount the first connecting frame with the plurality of the second connecting frames according to a waist circumference of the user. The first connecting frame and the plurality of the second connecting frames form a ring shape through cooperation of the fastening plates and the protruding columns. Then the hula hoop body is fixed on a waist of a human body. The connecting plate and the roller are stuck in the second connecting frames through the openings. Then a length of the connecting rope is adjusted, the connecting rope is connected with the tapered weight ball through the lock ring. Then, the user rotates the waist to make the tapered weight ball rotate. When the tapered weight ball moves, the roller press the support columns in turn, and the top blocks massage the waist of the human body under action of the springs. The top blocks are able to massage the waist of the human body. Further, The smart weighted hula hoop is highly comfortable to use and users with different waist circumferences can use the smart weighted hula hoop to exercise and massage.

In the present disclosure, the first connecting frame and the second connecting frames are connected to form a ring structure through the snapping assembly of the fastening plates and the protruding columns, and fixed on the waist of the human body. By increasing or reducing the number of the second connecting frames, the smart weighted hula hoop can be applied to users with different waist circumferences, which makes the present disclosure highly adaptable.

In the present disclosure, the first connecting frame and the second connecting frames comprise openings. By setting the openings, the hula hoop body is connected to the connecting plate and the roller. The roller rotates in the first connecting frame and the plurality of the second connecting frames to make the tapered weight ball to rotate. When the tapered weight ball moves, the roller press the support columns in turn, and the support columns press the springs to make the top blocks massage the waist of the human body under action of the springs. Thus, the top blocks are able to massage the waist of the human body. Further, the use effect of the smart weighted hula hoop is good.

In the present disclosure, the connecting plate and the connecting head are connected with the connecting rope. By adjusting the length of the connecting rope, a weight of the smart weighted hula hoop when it rotates is different. Moreover, the tapered weight ball is able to adjust a weight itself. The use effect of the smart weighted hula hoop is good.

In the present disclosure, the hula hoop body is composed of the first connecting frame and the second connecting frames, which is convenient to assemble and disassemble. The first connecting frame comprises the housing. The housing combines with the magnetic sensor to intelligently calculate the number of turns and feedback data to the display screen at the same time. Further, it can be used for calorie consumption calculation at the same time, and the smart weighted hula hoop is highly intelligent.

1—first connecting frame; 2—fastening plate; 3—second connecting frame; 4—reinforcing block; 5—sleeve; 6—fixing sleeve; 7—top block; 8—tapered weight ball; 9—blocking cover; 10—lock ring; 11—connecting rope; 12—connecting head; 13—connecting plate; 14—roller; 15—limit block; 16—spring; 17—lock seat; 18—through hole; 19—protruding column; 20—display screen; 21—touch switch; 22—housing.

DETAILED DESCRIPTION

Technical solutions in the embodiments of the present disclosure will be clearly and completely described below in conjunction with the accompanying drawings in the embodiments of the present disclosure. Obviously, the described embodiments are only portions of the embodiments of the present disclosure, rather than all the embodiments. Based on the embodiments of the present disclosure, all other embodiments obtained by those of ordinary skill in the art without creative work shall fall within the protection scope of the present disclosure.

Figure 1:
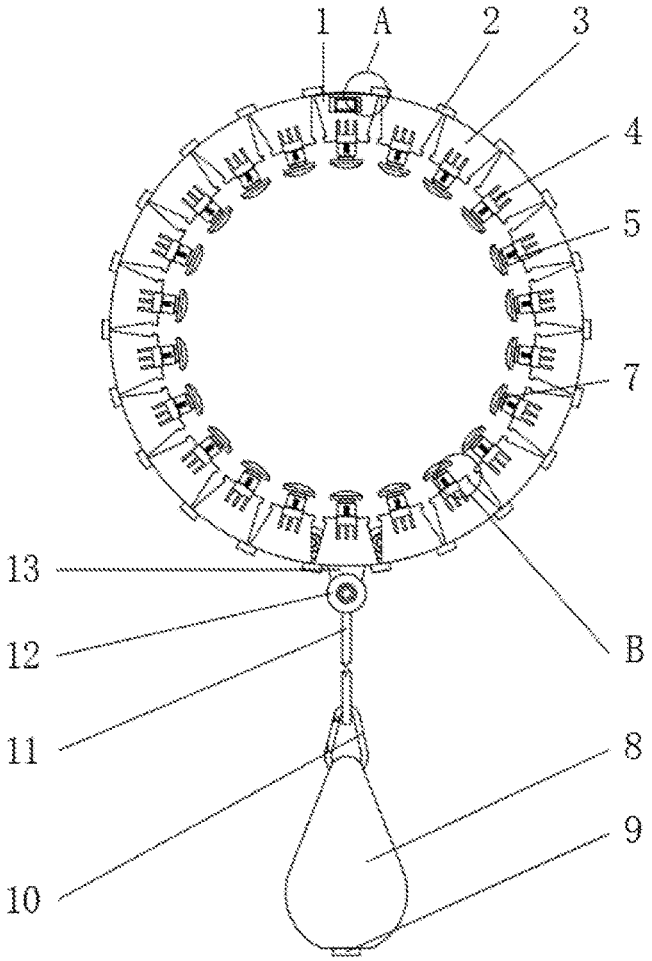
FIG. 1 is a front schematic diagram of a smart weighted hula hoop of the present disclosure.
Figure 2:
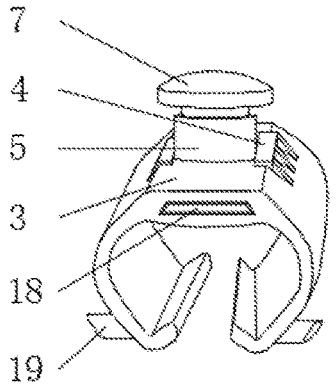
FIG. 2 is a perspective schematic diagram of a second connecting frame of the present disclosure.
Figure 3:
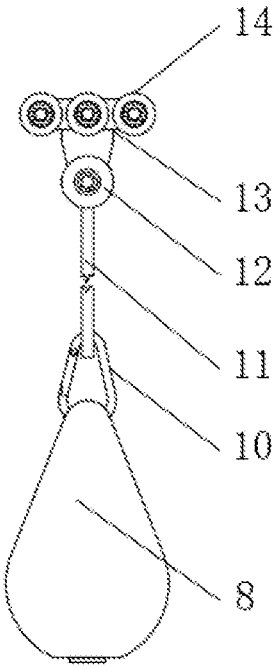
FIG. 3 is a front view of portions of the smart weighted hula hoop of the present disclosure.
Figure 4:
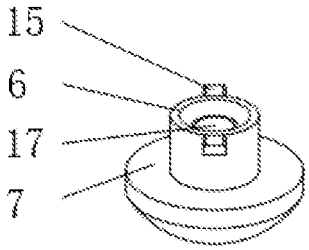
FIG. 4 is a perspective schematic diagram of a top block of the present disclosure.
Figure 5:
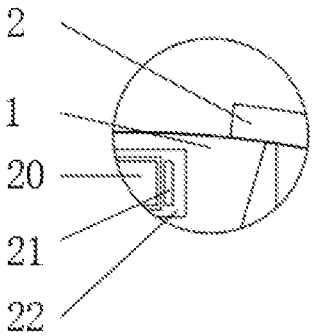
FIG. 5 is an enlarged view of area A shown in FIG. 1.
Figure 6:
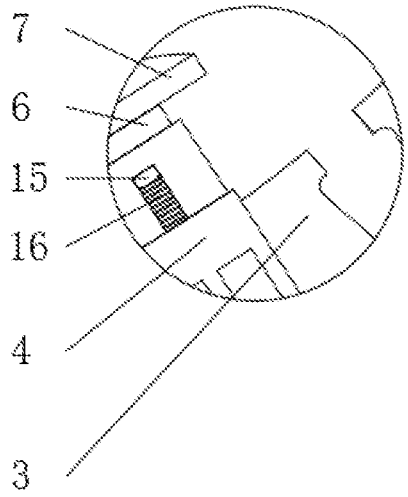
FIG. 6 is an enlarged view of area B shown in FIG. 1.

As shown in FIGS. 1-6, the present disclosure provides a smart weighted hula hoop. The smart weighted hula hoop comprises a first connecting frame 1, a plurality of second connecting frames 3, and a connecting plate 13.

The first connecting frame 1 and the second connecting frames 3 comprise protruding columns 19 and fastening plates 2. A snap-on groove is defined on each fastening plate 2. Each fastening plate 2 is fixedly connected with a respective protruding column 19 through each snap-on groove. A connection method herein is snap-fit assembly. Each protruding column 19 is snapped on a corresponding fastening plate 2 to make the first connecting frame 1 connected to the second connecting frames 3. The plurality of second connecting frames 3 are connected one by one in sequence. One side of the first connecting frame 1 is connected to a second connecting frame 3 arranged in a head end of the second connecting frames 3 connected one by one in sequence. Another side of the first connecting frame is connected to another second connecting frame 3 arranged on a tail end of the second connecting frames 3 connected one by one in sequence. The first connecting frame 1 is connected with the plurality of second connecting frames 3 to form a hula hoop body. A diameter of the hula hoop body is adjusted by adjusting the number of the second connecting frames, thereby improving adaptability of the hula hoop body.

A housing 22 is fixedly connected to the first connecting frame 1. A magnetic sensor is fixedly connected to the housing 22. The magnetic sensor is configured to calculate the number of turns of the hula hoop body, A display screen 20 is fixedly connected to an upper end of the housing 22. The display screen 20 displays the number of turns of the hula hoop body, as well as duration of exercise and calories consumed by a human body. A circuit board is arranged inside the housing 22. The first connecting frame 1 and each second connecting frame 3 are fixedly connected to a respective sleeve 5. A limit hole is provided on a bottom end of each sleeve 5. A support column is slidably connected to an inner wall of each limit hole. The bottom end of each sleeve 5 is fixedly connected to a respective spring 16. A fixing sleeve 6 is arranged on one end of each spring 16 away from each sleeve 5. Each fixing sleeve 6 is fixedly connected to a respective top block 7. Each fixing sleeve 6 is slidably connected to each sleeve 5. A position of each top block 7 is adjusted by setting the corresponding spring 16. The waist of the human body is massaged under actions of the top blocks 7.

The first connecting frame 1 and the second connecting frames 3 comprise openings. A roller 14 is arranged on the connecting plate 13. By setting the roller 14, the connecting plate 13 moves between the first connecting frame 1 and the second connecting frames 3 The connecting plate 13 is fixedly connected with a connecting head 12. A connecting rope 11 is arranged on the connecting head 12. The connecting rope 11 passes through a lock ring 10. The lock ring 10 passes through a tapered weight ball 8. By setting the lock ring 10, the connecting rope 11 and the tapered weight ball 8 are easy to maintain and replace, A bottom end of the tapered weight ball 8 is threadedly connected with a blocking cover 9. The blocking cover is configured to seal the tapered weight ball.

The first connecting frame 1 and the second connecting frames 3 comprise reinforcing blocks 4. Reinforcing plates are arranged on each reinforcing block 4. Each sleeve 5 is arranged between two corresponding reinforcing blocks 4 oppositely arranged with respect to each other. Each reinforcing block 4 and the corresponding reinforcing plates are integrally connected. The reinforcing blocks 4 on the first connecting frame 1 and the second connecting frames 3 are formed by injection molding.

Each sleeve 5 comprises a rectangular groove. An inner sidewall of each rectangular groove is slidably connected with corresponding limit blocks 15. Each fixing sleeve 6 is fixedly connected with bottom ends of corresponding limit blocks.

A lock seat 17 is arranged on an inner bottom portion of each fixing sleeve 6. Each lock seat 17 is integrally connected to each fixing sleeve 6. Each spring 16 is fixedly connected to each lock seat 17. The top blocks 7 have a reset function by setting the springs 16.

Optionally, a touch switch 21 is arranged on a right side of the display screen 20. A sealant is disposed between the touch switch 21 and the housing 22. The sealant is disposed between the touch switch 21 and the housing 22, which improve a sealing effect of the housing 22.

The tapered weight ball 8 is hollow. The tapered weight ball is configured to store liquid water. A weight of the tapered weight ball 8 is controlled by adjusting water inside the tapered weight ball 8.

The connecting plate 13 is arranged in the second connecting frames 3. Inner walls of the roller 14 are fixedly connected to a bearing. Inner walls of the bearing are fixedly connected with a fixing rod. A bottom end of the fixing rod is fixedly connected with the connecting plate 13. By setting the roller 14, the tapered weight ball 8 is movable in the hula hoop body.

A connecting rod is fixedly connected to the connecting head 12. The connecting rope 11 is arranged on the connecting rod, and the connecting rope 11 is fixed to the connecting rod by knotting the connecting rope. The connecting head 12 is connected with the connecting rope 11 through the connecting rod.

The first connecting frame 1 and the second connecting frames 3 comprise through holes 18. Each support column is arranged inside a respective through hole 18. A limit plate is arranged on each support column to limit sliding of each support column and each sleeve. The support columns are configured to press the springs 16.

A working principle is as follow. A user first mount the first connecting frame with the plurality of the second connecting frames according to a waist circumference of the user. The first connecting frame and the plurality of the second connecting frames form a ring shape through cooperation of the fastening plates and the protruding columns. Then the hula hoop body is sleeved on a waist of a human body. The connecting plate and the roller are stuck in the second connecting frames through the openings. Then a length of the connecting rope is adjusted, the connecting rope is connected with the tapered weight ball through the lock ring. Then, the user rotates the waist to make the tapered weight ball rotate. When the tapered weight ball moves, the roller press the support columns in turn, and the top blocks massage the waist of the human body under action of the springs. The top blocks are able to massage the waist of the human body. Further, The smart weighted hula hoop is highly comfortable to use and users with different waist circumferences can use the smart weighted hula hoop to exercise and massage.

Although the embodiments of the present disclosure have been shown and described, those of ordinary skill in the art can understand that various changes, modifications, and substitutions can be made to these embodiments without departing from the principle and spirit of the present disclosure. The scope of the present disclosure is defined by the appended claims and their equivalents.

What is claimed is:

1. A smart weighted hula hoop, comprising:

a first connecting frame;

a plurality of second connecting frames; and a connecting plate;

wherein the first connecting frame and the plurality of second connecting frames comprise protruding columns and fastening plates; a snap-on groove is defined on each of the fastening plates; each of the fastening plates is fixedly connected with a respective one of the protruding columns through each of the snap-on grooves; each of the protruding columns is snapped on a corresponding of the fastening plates to make the first connecting frame connected to the plurality of second connecting frames; the plurality of second connecting frames are connected one by one in sequence; one side of the first connecting frame is connected to a respective one of the plurality of second connecting frames arranged in a head end of the plurality of second connecting frames connected one by one in sequence; another side of the first connecting frame is connected to another second connecting frame of the plurality of second connecting frames arranged on a tail end of the plurality of second connecting frames connected one by one in sequence; the first connecting frame is connected with the plurality of second connecting frames to form a hula hoop body;

wherein a housing is fixedly connected to the first connecting frame; a magnetic sensor is fixedly connected to the housing; a display screen is fixedly connected to an upper end of the housing; a circuit board is arranged inside the housing; the first connecting frame and each of the plurality of second connecting frames are fixedly connected to a respective sleeve; a limit hole is provided on a bottom end of each of the respective sleeves; a support column is arranged on an inner wall of each of the limit holes; the bottom end of each of the sleeves is fixedly connected to a respective spring; a fixing sleeve is arranged on one end of each of the springs away from each of the sleeves; each of the fixing sleeves is fixedly connected to a respective top block; each of the fixing sleeves is slidably connected to each of the sleeves;

wherein the first connecting frame and the plurality of second connecting frames comprise openings; a roller is arranged on the connecting plate; the connecting plate is fixedly connected with a connecting head; a connecting rope is arranged on the connecting head; the connecting rope passes through a lock ring; the lock ring passes through a tapered weight ball; a bottom end of the tapered weight ball is threadedly connected with a blocking cover.

2. The smart weighted hula hoop according to claim 1, wherein the first connecting frame and the plurality of second connecting frames comprise reinforcing blocks; reinforcing plates are arranged on each of the reinforcing blocks; each of the sleeves is arranged between two corresponding reinforcing blocks of the reinforcing blocks oppositely arranged with respect to each other.

3. The smart weighted hula hoop according to claim 1, wherein each of the sleeves comprises a rectangular groove; an inner sidewall of each of the rectangular grooves is slidably connected with corresponding limit blocks; each of the fixing sleeves is fixedly connected with bottom ends of the corresponding limit blocks.

4. The smart weighted hula hoop according to claim 1, wherein a lock seat is arranged on an inner bottom portion of each of the fixing sleeves; each lock seat is integrally connected to each of the fixing sleeves, each of the springs is fixedly connected to each lock seat.

5. The smart weighted hula hoop according to claim 1, wherein a touch switch is arranged on a right side of the display screen; a sealant is disposed between the touch switch and the housing.

6. The smart weighted hula hoop according to claim 1, wherein the tapered weight ball is hollow; and the tapered weight ball is configured to store liquid water.

7. The smart weighted hula hoop according to claim 1, wherein the connecting plate is arranged in the plurality of second connecting frames; inner walls of the roller are fixedly connected to a bearing, inner walls of the bearing are fixedly connected with a fixing rod; a bottom end of the fixing rod is fixedly connected with the connecting plate.

8. The smart weighted hula hoop according to claim 1, wherein a connecting rod is fixedly connected to the connecting head, the connecting rope is arranged on the connecting rod, and the connecting rope is fixed to the connecting rod by knotting the connecting rope.

9. The smart weighted hula hoop according to claim 1, wherein the first connecting frame and the plurality of second connecting frames comprise through holes; each of the support columns is arranged inside a respective through hole, a limit plate is arranged on each of the support columns to limit sliding of each of the support columns and each of the sleeves.

* * * * *